United States Patent [19]

Davis

[11] Patent Number: 4,768,689

[45] Date of Patent: Sep. 6, 1988

[54] MULTI-PURPOSE SLING APPARATUS

[76] Inventor: Dale C. Davis, 11301 Davenport St., Suite 6, Omaha, Nebr. 68154

[21] Appl. No.: 751

[22] Filed: Jan. 6, 1987

[51] Int. Cl.[4] ..... A45F 3/14

[52] U.S. Cl. ..... 224/257; 224/268; 224/150; 224/913; 224/916

[58] Field of Search ..... 224/150, 257, 258, 913, 224/917, 202, 910, 268; 294/147, 149, 150

[56] References Cited

U.S. PATENT DOCUMENTS

| | | | |
|---|---|---|---|
| 1,292,875 | 1/1919 | Randall | 224/150 |
| 2,574,143 | 11/1951 | Colby | 224/913 X |
| 2,779,521 | 1/1957 | Granberg | 224/150 |
| 3,211,351 | 10/1965 | Somple | 224/150 |
| 3,441,185 | 4/1969 | Moomaw | 224/150 |
| 3,495,770 | 2/1970 | Seltmann, Jr. | 224/150 |
| 3,559,853 | 2/1971 | Strassman | 224/258 |
| 4,440,334 | 4/1984 | Kappel et al. | 224/258 |
| 4,470,528 | 9/1984 | Dyess | 224/257 |

*Primary Examiner*—Henry J. Recla
*Assistant Examiner*—David Voorhees
*Attorney, Agent, or Firm*—Zarley, McKee, Thomte, Voorhees & Sease

[57] ABSTRACT

A multi-purpose sling includes an elongated flexible strap with a hook attached to one end, with the other end of the strap attached to the middle bar of a slide buckle threaded on the strap, thereby forming an adjustable loop. A second hook is attached to a ring which is threaded onto the strap in the adjustable loop. Each hook is J-shaped and large enough to freely hold the string of a compound bow.

In a second embodiment, a hook is attached to one end of a flexible strap and the strap is then looped through a large ring. The strap is then threaded through a ring attached to the strap near the first hook, and then through a second ring which is loose on the strap. The other end of the strap is then fastened to the large ring to form a double loop arrangement. A second hook is connected to the loose ring. In this embodiment, the hooks are generally U-shaped with a narrow throat portion which will snap onto a ring or similar member on the item to be carried. A slot in the J-shaped hook in the first embodiment allows the J-shaped hook to be connected to the U-shaped hook.

3 Claims, 2 Drawing Sheets

MULTI-PURPOSE SLING APPARATUS

TECHNICAL FIELD

This invention relates generally to slings for compound bows, and more particularly to an improved sling which may be utilized with bows, rifles, shotguns and other weapons.

BACKGROUND OF THE INVENTION

While many types of slings have been provided for conveniently carrying a rifle or shotgun, there are very few devices for carrying either simple or compound bows. Carrying a bow while hiking or riding during hunting will quickly become fatiguing on the hunter's arms, especially in the case of the heavier compound bows. Similarly, while perched in a tree waiting for the quarry, it is quite fatiguing to have to hold the bow for a long period of time.

One over-the-shoulder bow sling which is presently available is fastened at each end of the handle, near the grip, where the limbs of the bow are attached to the handle. However, the design is not susceptible to being quickly released for immediate use. Furthermore, the bow is not carried in the "ready" position, since the string hangs below the handle. It is therefore necessary to turn the bow upwardly before bringing it up into a firing position. While some of the prior art bow slings include "quick release" devices, these devices must be mechanically operated in order to release the bow. Thus, manipulation of the release in order to use the bow could take enough time so that the hunter misses the "perfect" shot. While the bow typically can be operated without releasing these prior art slings, it is believed that any attachments to the bow can add enough weight or be otherwise distracting, so as to be bothersome while shooting.

Furthermore, none of the prior art bow slings are capable of use on rifles or shotguns or the like, nor are the known rifle slings capable of use on bows. It is therefore necessary for the hunter to buy and become acquainted with a number of various sling devices for each particular weapon he chooses. It is also desirable for the sling to be capable of many uses, other than the carrying of a weapon.

It is therefore an object of the present invention to provide an improved sling for bows.

Another object is to provide a sling which may be used on either a bow or a rifle or the like.

Yet another object of the present invention is to provide a sling which is adjustable in length.

Still another object is to provide a sling which releases a bow without requiring manipulation of a mechanical device.

A further object of the present invention is to provide a sling which may be worn in a variety of positions.

Another object of the present invention is to provide a sling which may be easily adjusted in length while it is worn.

These and other objects will be clear to those skilled in the art.

SUMMARY OF THE INVENTION

The multi-purpose sling of this invention includes an elongated flexible strap with a hook attached to one end, with the other end of the strap attached to the middle bar of a slide buckle threaded on the strap, thereby forming an adjustable loop. A second hook is attached to a ring which is threaded onto the strap in the adjustable loop. Each hook is J-shaped and large enough to freely hold the string of a compound bow. In operation, the bow will hang from its string within the hooks of the sling, with the bow handle at approximately hand length.

In a second embodiment, a hook is attached to one end of a flexible strap and the strap is then looped through a large adjustment ring. The strap is then threaded through a ring attached to the strap near the first hook, and then through a second ring which is loose on the strap. The other end of the strap is then fastened to the adjustment ring to form a double loop arrangement. A second hook is connected to the loose ring. In this embodiment, the double loop arrangement provides a variety of positions for carrying bows, rifles or other things. In this embodiment, the hooks are generally U-shaped with a narrow throat portion which will snap onto a ring or similar member on the item to be carried. The hook is large enough in the throat portion to hold a bow string as well. Also, a slot in the J-shaped hook in the first embodiment allows the J-shaped hook to be connected to the U-shaped hook—thereby allowing for the interchangeable use of either hook on the sling.

BRIEF DESCRIPTION OF THE DRAWINGS

FIG. 7 is a pictorial view of the second embodiment of this invention, showing yet another arrangement of the sling with the hooks slanted horizontally for carrying backpacks and the like.

DESCRIPTION OF THE PREFERRED EMBODIMENT

Figure 1:
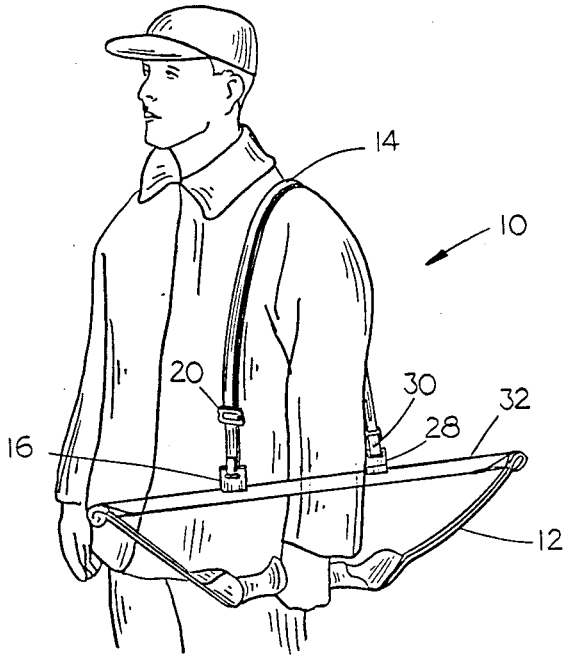
FIG. 1 is a pictorial view of a hunter with the sling device of the invention holding a bow in an over-the-shoulder quick-release position.

Referring now to the drawings, the sling device of this invention is designated generally at 10 and is adapted to carry a bow 12, as shown in FIG. 1. Sling device 10 includes a flexible strap 14 having one end attached to a hook 16.

Figure 2:
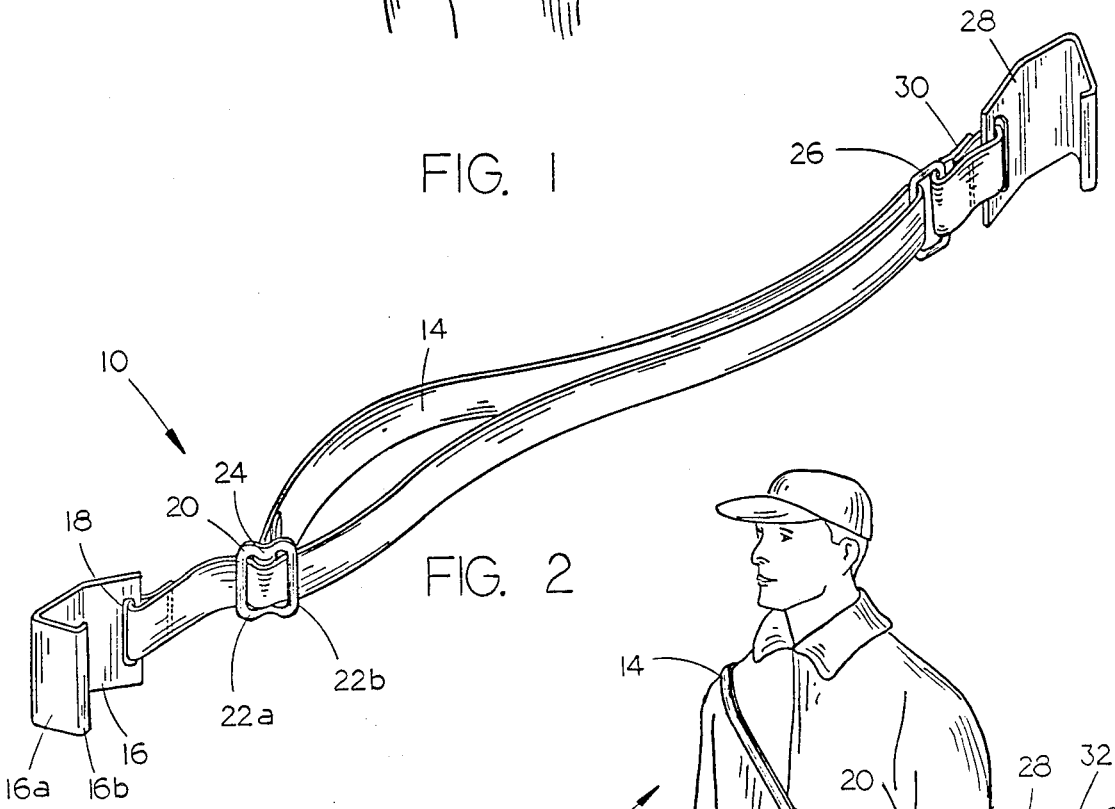
FIG. 2 is a perspective view of the invention.

As shown in FIG. 2, strap 14 is threaded through a slot 18 in hook 16 and is then folded back upon itself and sewn in position. Strap 14 extends from hook 16 and is connected to a length-adjusting slide buckle 20. Strap 14 is looped about the middle bar 24 of slide buckle 20 such that buckle 20 will slide along strap 14. Strap 14 then extends to loop about one side of a ring 26 and extends back to be fastened to middle bar 24 of slide buckle 20. A second hook 28 is attached to ring 26 via a short connecting strap 30. The distance between hooks 16 and 28 may be adjusted by sliding the buckle 20 either towards hook 16 or towards hook 28.

Hooks 16 and 28 are generally J-shaped spring steel, thereby giving a sufficient weight to keep sling 10 in position once placed over the shoulder of the user. A plastic coating on hooks 16 and 28 protects bow 12 from scratches and also protects hooks 16 and 28 from the weather. The depth of hook 16, which is measured by the depth of cross piece 16*a*, must be great enough to allow string 32 of a compound bow 12 to be easily removed. Likewise, the height of lip 16*b* of hook 16 is great enough to retain string 32 of bow 12 within hook 16 during slight vertical movement—which would occur while walking, etc.

Figure 3:
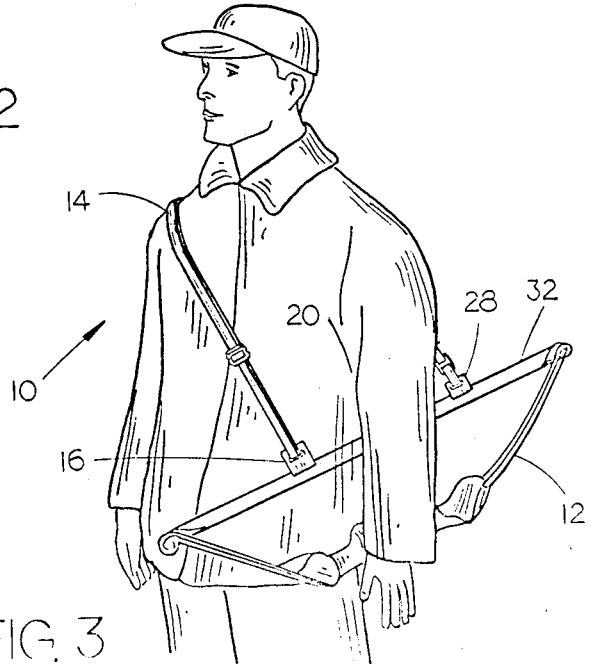
FIG. 3 is a pictorial view of a hunter with the sling rearranged over the opposite shoulder and holding a bow in a carrying position.

As shown in FIG. 3, the sling device 10 can also be utilized as an over-the-head loop-type sling, by moving slide buckle 20 towards hook 16 to form a large loop between slide buckle 20 and hook 28. By looping strap 14 over the user's head, hooks 16 and 28 may be attached to the bow string 32 and hold bow 12 in stable condition against the user's body.

Figure 8:
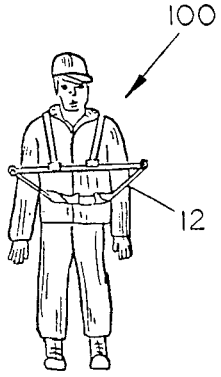
FIG. 8 is a pictorial view of the second embodiment of this invention, showing another arrangement of the sling for carrying a bow, the sling draped around the neck with the bow in front of the hunter.

The sling device 10 of this invention also allows the user to hold the bow crossways either in front or behind the user, as seen in FIG. 8, by looping strap 14 about the user's neck, with both hooks 16 and 28 either in front or in back.

Figure 4:
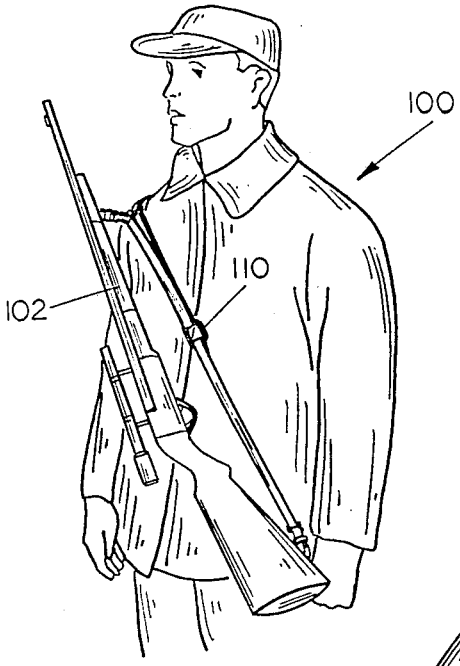
FIG. 4 is a pictorial view of a hunter with a second embodiment of the sling device of this invention, the sling attached to a rifle and positioned diagonally across the chest and back of the hunter.

Referring now to FIGS. 4–8, a second embodiment of the invention is identified generally at 100 and is shown attached to a rifle 102 in FIG. 4. In this embodiment, a strap 104 has one end attached to one side of a rectangular ring 106, and one side of a second rectangular ring 108 is connected to strap 104 adjacent ring 106. Strap 104 extends from ring 106 and loops through a large adjustment ring 110 and then back towards rings 106 and 108. Strap 104 is then looped through ring 108 and reversed back upon itself—thereby creating three layers of strap at one end identified generally at 100*a*. Strap 104 then extends from ring 108 and is looped about one side of a third rectangular ring 112 and then affixed to the other side of large ring 110. Rectangular ring 106 thereby forms one end 100*a* of strap 104, while the third rectangular ring 112 forms the other end 100*b*.

Each end ring 106 and 112 has a hook 114 pivotally fastened thereto. Each hook 114 is generally U-shaped with one lip 116 bent over the side of ring 106 and 112, and the other lip 118 bent outwardly. A throat portion 120, adjacent lips 116 and 118, has a depth less than that of the base of the U-shape, identified as 122. Hooks 114 are of spring steel or some other slightly resilient and springable material.

Figure 5:
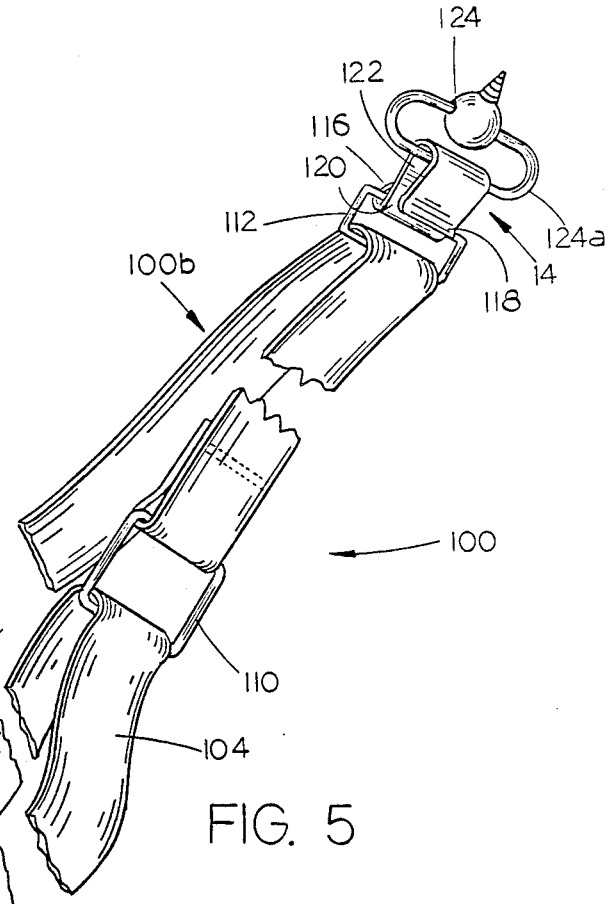
FIG. 5 is a perspective view of the second embodiment of the sling device.

FIG. 5 shows end 100*a* of sling device 100 attached to a hook 16 for use with the bow. End 100*b* is shown attached to a ring and ball means 124 which are commonly fastened to rifles, shotguns and the like. The depth of throat portion 120 of hooks 114 is less than the diameter of the cross section of one side of ring portion 124*a* of ring and ball member 124. Similarly, slot 18 in hook 16 is positioned for possible use on hook 114. The depth of throat 120 allows both the hook 16 or the ring 124*a* to "snap" into position in hook members 114. Thus, sling 100 may either be snapped onto the ring and ball members 124 on a rifle, shotgun or the like, or be snapped onto hooks 16 in order to be used with a bow. Hooks 114 will thereby allow interchangeable use on either hook 16 or ring and ball member 124.

It should also be noted that it is not necessary to use hook 16 in order to use sling 100 with a bow. Hooks 114 will hold the string of a bow, but the configuration of hook 16 is preferred since the string is more easily removed from these hooks.

Figure 6:
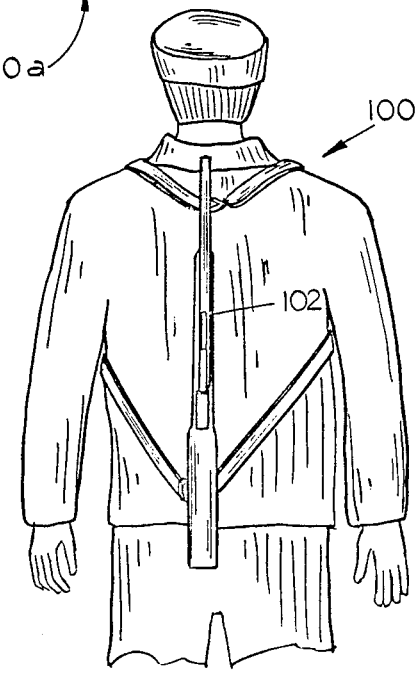
FIG. 6 is a pictorial view of the second embodiment of this invention, showing another arrangement of the sling for carrying a weapon.

Sling 100 may be utilized in a variety of positions. It can be used as a simple single strap over the shoulder or about the neck, as discussed in the first embodiment. It can also be used to form a loop diagonally across the chest as shown in FIG. 4. Yet another configuration is shown in FIG. 6, wherein a backpack-like arrangement with the hooks 114 arranged vertically, to hold a rifle 102 vertically on the back.

Figure 7:
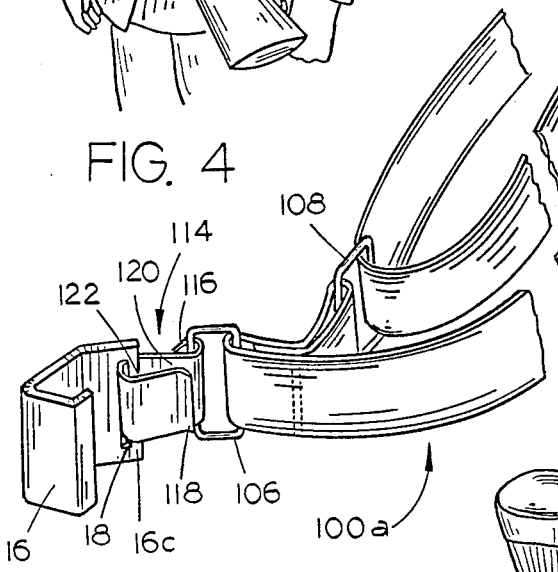
Figure 7:
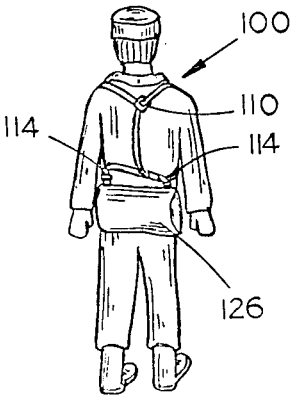

FIG. 7 shows an arrangement for carrying a pack 126, or other equipment, with the hook members 114 arranged horizontally in the back. Note that sling 100 is adjusted to form two loops through which the arms are inserted. Another arrangement is shown in FIG. 8, wherein the hooks 16 are attached to hook members 114, in order to carry bow 12. With the bow 12 hung in front, as shown, the hunter may easily drag large game behind him without interference from the bow 12.

As shown in FIG. 4, the length of the sling 100 may be easily adjusted by inserting a finger in large ring 110 (located adjacent the user's chest), and pulling it downwards across the chest or upwards towards the shoulder. Thus the sling is easily adjusted for the desired fit.

It can therefore be seen that at least all of the objectives stated above are fulfilled by the invention.

I claim:

1. A sling device for a bow having a string and handle portion comprising:

an elongated flexible strap having first and second ends;

a first non-closable hook member attached to the first end of said strap;

a slide buckle having a center bar, selectively slidably adjustably fastened to said strap with said strap looped around the center bar of said slide buckle;

a second non-closable hook member slidably connected to said strap between said slide buckle and the second end of said strap;

said strap being connected at its second end to the center bar of said slide buckle; and said first and second hook members include a generally U-shaped resilient plate open at its upper end and having a width substantially the same as the strap;

a ring member connecting each said hook member to said strap;

wherein one lip of the U-shaped plate is bent outwardly and around said ring member; the other lip of "U" being bent slightly outwardly to increase the width of the open end of the "U";

said U-shaped plate having a throat portion formed adjacent the lip portions wherein the distance between the legs of the "U" is narrowed, the width of the throat being large enough to freely receive a bow string.

2. A multipurpose sling device capable of attachment to a bow, or to a weapon having rings fastened to its fore and butt ends, comprising:

an elongated flexible strap having first and second ends:

the first end of said strap having a first and second ring member attached thereto in spaced relation to one another, said first ring located at the end and the second ring located slightly inwardly therefrom;

said strap being looped about one side of a large ring, then looped back about said second ring member and fastened at its second end to the opposing side of said large ring;

a third ring member slidably connected to said strap between said large ring and said second ring member;

a hook member attached to said first and third ring members; and attachment means removably connected to each said hook member, for selectively attaching said sling to the bow or the weapon.

3. The multi-purpose sling device of claim 2, wherein said attachment means comprises first and second interchangeable weapon-fastening assemblies, said first weapon-fastening assembly comprising a generally J-shaped hook means with the lip of the "J" generally parallel to the back of the "J", and having a slot in the back through which said J-shaped hook is removably snapped on to said hook means on said first and third ring members, and said second weapon-fastening assembly comprising a ring member connected to the fore or butt ends of a weapon.

* * * * *